US006659034B1

(12) United States Patent
Levey

(10) Patent No.: US 6,659,034 B1
(45) Date of Patent: Dec. 9, 2003

(54) RETRACTABLE MOORING FITTING ASSEMBLY

(75) Inventor: James R. Levey, Tracyton, WA (US)

(73) Assignee: Art Anderson Associates, Bremerton, WA (US)

( * ) Notice: Subject to any disclaimer, the term of this patent is extended or adjusted under 35 U.S.C. 154(b) by 0 days.

(21) Appl. No.: 10/217,668

(22) Filed: Aug. 12, 2002

(51) Int. Cl.[7] ..... B63B 21/00
(52) U.S. Cl. ..... 114/230.2; 114/218
(58) Field of Search ..... 114/230.1, 230.16, 114/230.2, 230.26, 218, 381, 343

(56) References Cited

U.S. PATENT DOCUMENTS 4,890,566 A * 1/1990 Morris ..... 114/218
5,087,063 A * 2/1992 Merrill, Jr. ..... 280/475
5,379,977 A * 1/1995 Ronn et al. ..... 248/277.1
5,438,944 A * 8/1995 Burke ..... 114/218
5,535,694 A * 7/1996 Czipri ..... 114/218

* cited by examiner

*Primary Examiner*—Stephen Avila
(74) *Attorney, Agent, or Firm*—Black Lowe & Graham PLLC

(57) ABSTRACT

A retractable mooring fitting assembly for a marine vessel includes a mooring fitting that has a first end and a second end. A counterweight is disposed toward the second end of the mooring fitting. An axle is interposed between the counterweight and the first end, and the mooring fitting is pivotable about the axle. At least a first bearing provides a load path from the mooring fitting to the marine vessel.

32 Claims, 10 Drawing Sheets

RETRACTABLE MOORING FITTING ASSEMBLY

GOVERNMENT LICENSE RIGHTS

This invention was made with Government support under U.S. Government contract N00014-01-C-0081 awarded by the Department of the Navy. The Government has certain rights in this invention.

FIELD OF THE INVENTION

This invention relates generally to marine mooring hardware and, specifically, to mooring fittings.

BACKGROUND OF THE INVENTION

Mooring fittings are used in a variety of maritime applications. In some maritime applications, it is desirable that the mooring fitting be removable or retractable. However, some currently known removable or retractable mooring fittings require use of lifting devices powered by the marine vessel. Other currently known removable or retractable mooring fittings can present hazards to line-handling personnel.

For example, some marine vessels with a flat deck, such as barges, include bitts that are removable. Currently known removable bitts are typically attached to the deck with bolts. The bolts therefore present potentially weak load paths between the bitt and the marine vessel. Further, such removable bitts are typically heavy and require lifting devices to install and remove the bitts to and from the deck of the marine vessel. Power for such lifting devices is supplied from the marine vessel.

Some ocean-going tugboats have retractable towline guideposts. The retractable towline guideposts are typically hydraulically retracted below the deck of the tug and are hydraulically raised above deck for use. Again, hydraulic power for retracting and deploying the towline guideposts is supplied by the marine vessel.

Further, some naval submarines include retractable mooring cleats. The cleat rotates below the outer non-pressure hull to reduce surface drag. The retractable mooring cleats are bolted in a stowed or deployed position. Each half of the cleat is spring-loaded to rotate between the stowed and deployed positions. To change the position of the retractable mooring cleat between the stowed and deployed positions, the mooring cleat is unbolted and each half of the cleat is mechanically agitated to cause the spring to begin urging the cleat to its desired position. However, such operations are potentially dangerous and present hazards to line handling personnel. For example, extremities of line handling personnel may be subject to severe trauma if any of the extremities are in the vicinity of the cleat when the spring urges the cleat rapidly past an edge of the deck surface.

Thus, there is an unmet need in the art for a retractable mooring fitting that provides robust load paths between the mooring fitting and the marine vessel, does not require power from the marine vessel to retract or deploy the mooring fitting, and that minimizes potential hazards to line handling personnel.

SUMMARY OF THE INVENTION

The invention provides a retractable mooring fitting assembly that provides robust load paths between the mooring fitting and the marine vessel, does not require power from the marine vessel to retract or deploy the mooring fitting, and that retracts and deploys in a manner that minimizes potential hazards presented to line handling personnel.

According to one non-limiting embodiment of the invention, a retractable mooring fitting assembly for a marine vessel includes a mooring fitting that has a first end and a second end. A counterweight is disposed toward the second end of the mooring fitting. An axle is interposed between the counterweight and the first end, and the mooring fitting is pivotable about the axle.

According an aspect of the invention, at least a first bearing is attached to the mooring fitting. The at least first bearing is arranged to provide at least a first load path from the mooring fitting to the marine vessel. The at least first bearing is disposed intermediate the first end of the mooring fitting and the axle.

According to another aspect of the invention, a second bearing is attached to the mooring fitting. A second bearing is arranged to provide a second load path from the mooring fitting to the marine vessel. The second bearing is disposed toward the second end of the mooring fitting. If desired, the second bearing includes the counterweight.

BRIEF DESCRIPTION OF THE DRAWINGS

The preferred and alternative embodiments of the present invention are described in detail below with reference to the following drawings.

DETAILED DESCRIPTION OF THE INVENTION

Figure 1:
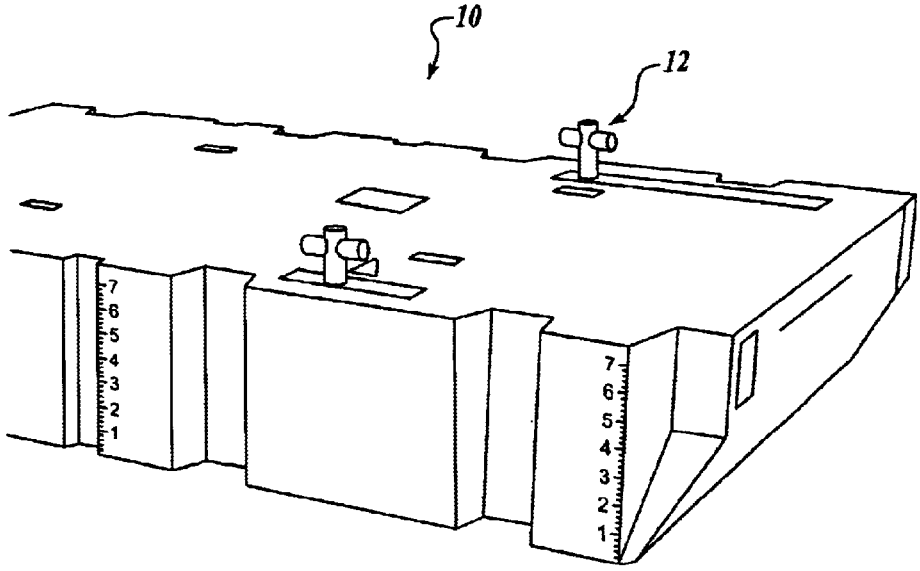
FIG. 1 is a perspective view of a non-limiting marine vessel that includes the mooring fitting assembly of the present invention.

FIG. 1 shows a non-limiting example of a marine vessel 10, such as a barge, that includes a retractable mooring fitting assembly 12. According to the invention, the mooring fitting assembly 12 advantageously retracts below a deck surface 14 that is attached to the tops of sides of the marine vessel 10. For example, the marine vessel 10 may be connected to a plurality of barges to form a floating platform or causeway for deployment during amphibious operations at unimproved beach locations. In such an application, the mooring fitting assembly 12 is suitably used to tie ships or other marine vessels (not shown) to the marine vessel 10 and to connect the combination of the barges to moorage systems, such as anchors. However, when the mooring fitting assembly 12 is not in use for tying up ships or other marine vessels or for connecting the barge to a moorage system, the mooring fitting assembly 12 may interfere with operations. Further, when the mooring fitting assembly 12 extends above the deck surface 14 in a deployed position, the mooring fitting assembly 12 prevents stacking the barge for stowage. Advantageously, the mooring fitting assembly 12 retracts and is stowed below the deck surface 14 when the mooring fitting assembly 12 is not in use or when it is desired to stack the barge for stowage. Alternately, the marine vessel 10 suitably includes a tug and the mooring fitting assembly 12 suitably includes a towline guidepost.

Figure 2:
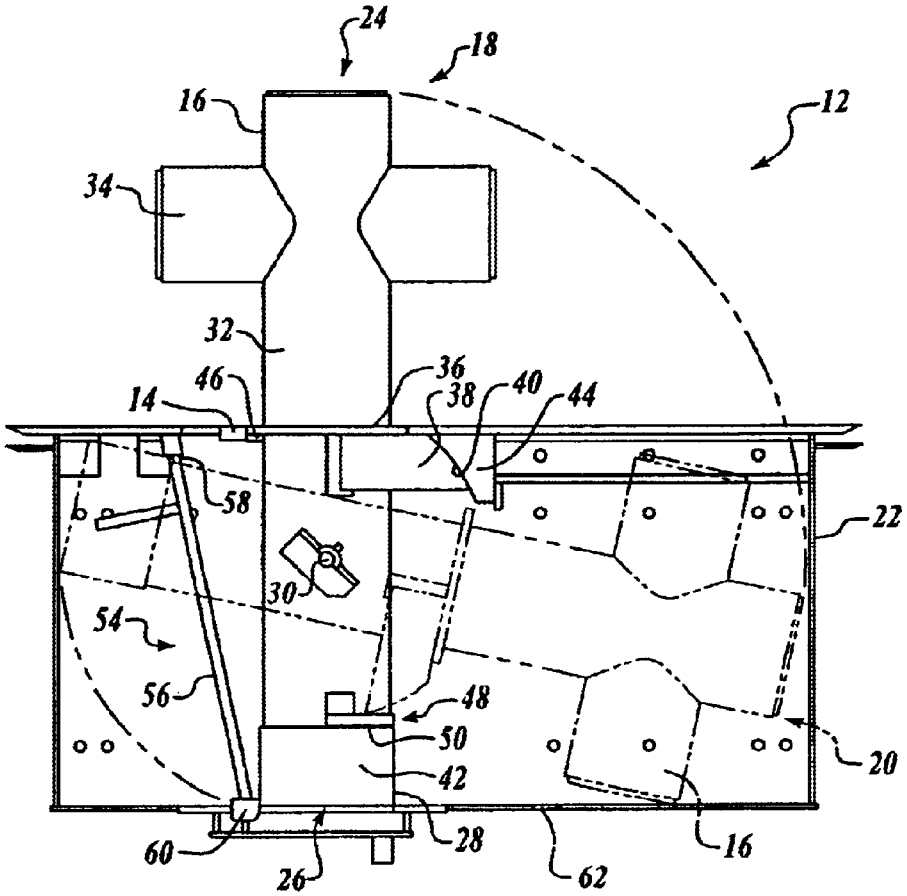
FIG. 2 is an exposed side view of the mooring fitting assembly of the present invention.

Referring now to FIG. 2 and by way of overview, the mooring fitting assembly 12 includes a mooring fitting 16, such as without limitation a post bitt (showed in phantom). The mooring fitting 16 is shown deployed in a first position 18 and stowed in a second position 20 in an enclosure 22 that is disposed beneath the deck surface 14 of a marine vessel (not shown). The mooring fitting 16 has a first end 24 and a second end 26. A counterweight 28 is disposed toward the second end 26. An axle 30, such as a rotational pin, is interposed between the counterweight 28 and the first end 24, such that the mooring fitting 16 is pivotable about the axle 30.

Further details of an embodiment of the invention are discussed below. In one presently preferred embodiment of the invention, the mooring fitting 16 suitably includes a bitt, such as without limitation a post bitt. Given by way of non-limiting example, the post bitt 16 includes a post member 32 and a cross member 34 that is disposed substantially normal to the post member 32 toward the first end 24. The present invention advantageously accommodates mooring fittings 16 of various sizes. For example, the mooring fitting 16 may have a design capacity of up to 140,000 pounds or more, depending on a desired application. However, it will be appreciated that the present invention can accommodate mooring fittings 16 that are scalable up or down to sizes as large or small as desired for a particular application. It will further be appreciated that the present invention accommodates various mooring fittings, such as without limitation bitts such as post bitts, towline guideposts, cleats, double bitts, chocks, and the like.

The axle 30 is suitably any cylindrical member, such as without limitation a pivot pin, that provides a pivot point about which the mooring fittings 16 can pivotally rotate. Advantageously, the axle 30 can be the only component of the present invention to be lubricated. Further, as will be discussed in detail below, live loads do not pass though the axle 30. That is, the axle 30 is not a live load path between the marine vessel and the mooring fitting 16.

The counterweight 28 is attached to the second end 26 of the mooring fitting 16 in any acceptable, known manner. The size and weight of the counterweight is scalable according to a desired application. Advantageously, in one non-limiting example, when the mooring fitting 16 includes a bitt with a design capacity of around 140,000 pounds, the counterweight is sized such that the mooring fitting 16 deploys or stows by rotating about the axle 30 with an applied force of around 45 pounds or less. It will be appreciated that neither dedicated machinery nor a source of power from the marine vessel is necessary to deploy or stow the mooring fitting 16. As a result, the mooring fitting 16 can be deployed or stowed quickly even in rough seas.

The present invention includes bearing surfaces that provide load paths for transmitting live loads between the mooring fitting 16 and the marine vessel. Advantageously, the live loads are transmitted via bearing surfaces instead of through the axle 30. In one non-limiting embodiment, a section 36 of the deck surface 14 is fastened to the post member 32 intermediate the cross number 34 and the axle 30 to provide one or more upper bearing surfaces. In one present. non-limiting example three upper bearing surfaces are provided. It will be appreciated that the section 36 is fastened to the post member 32 such that the section 36 aligns with the deck surface 14 when the mooring fitting 16 is in the first position 18. The section 36 is suitably fastened to the post member 32 in any acceptable known manner. A radius bearing 38 is fastened to the post member 32 beneath the section 36. The radius bearing 38 defines a mating surface 40 that defines a finite radius. A lower bearing 42 is provided toward the second end 26. In one present embodiment, the counterweight 28 provides the lower bearing 42.

Advantageously, the present invention also provides the enclosure 22, such as a vault, for rotatably mounting the mooring fitting 16. The axle 30 is rotatably mounted to the enclosure 22. Further, as will be discussed below, live loads are transmitted into the top and bottom of the enclosure 22 from the mooring fitting 16. In turn, the live loads are transmitted from the enclosure 22 to the marine vessel in tension, sheer, and compression. As a result, live loads are not transmitted through the axle 30 as a load path. The enclosure 22 includes a mating radius bearing 44. The mating radius bearing 44 includes a mating surface with a finite radius that is sized to mate with the surface 40. As such, the bearings 38 and 44 both provide a load path and permit rotation to and from the first position 24.

An upper retainer 46 is provided beneath the section 36 to prevent downward motion of the mooring fitting 16. A lower retainer 48 includes a surface 50. When the mooring fitting 16 is in the first position 18, the counterweight 28 contacts the surface 50. As a result, the lower retainer 48 prevents upward motion when the mooring fitting 16 is deployed in the first position 18.

A latching mechanism 54 is provided to prevent rotation of the mooring fitting 16 while deployed in the first position 18. In one present embodiment, the latching mechanism 54 includes a removable elongate member 56 that has a first end 58 and a second end 60. The first end 58 is retained by the enclosure 22 beneath the deck surface 14. The second end 60 abuts against the counterweight 28. Other latching mechanisms may be used as desired for a particular application.

Advantageously, the enclosure 22 with the mooring fitting 16 received therein may be installed as one composite unit beneath the deck surface 14 of the marine vessel. The enclosure 22 is suitably installed in the marine vessel in any acceptable manner, such as bolting or welding. The enclosure 22 advantageously can serve as a storage container for the mooring fitting 16. As a result, additional storage facilities for the mooring fitting 16 are avoided.

Removable covers (not shown) for the enclosure 22 are also provided. The removable covers cover the enclosure 22 and bridges deck live loads across the enclosure 22 when the mooring fitting 16 is stowed or deployed. In one non-limiting embodiment, the cover can support live loads of 12,000 lbs./sq. ft. or more.

Figure 3:
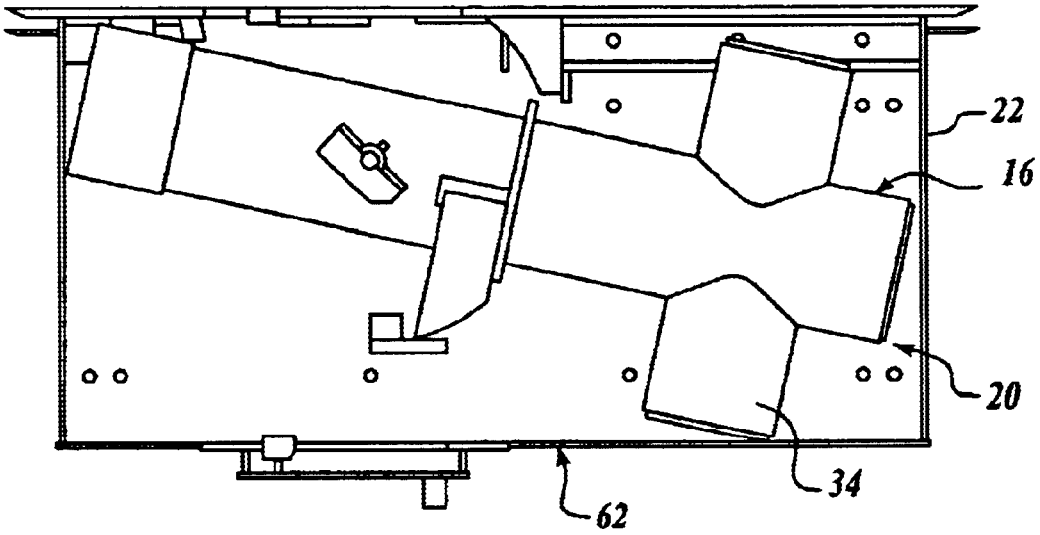
FIGS. 3–10 are side views of the mooring fitting assembly of the present invention being rotated between a stowed position and a deployed position.
Figure 4:
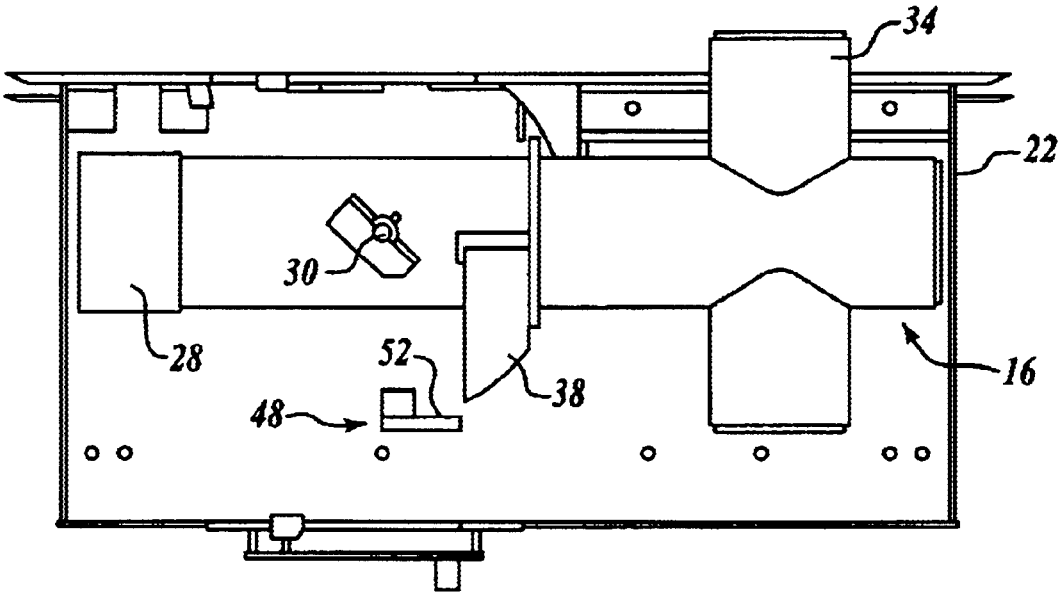
Figure 5:
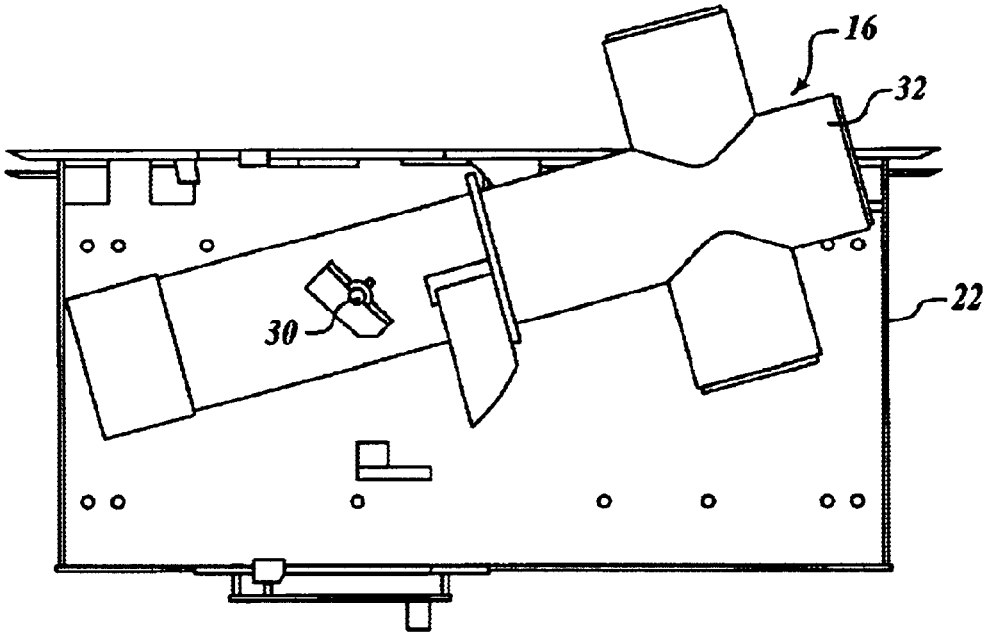
Figure 6:
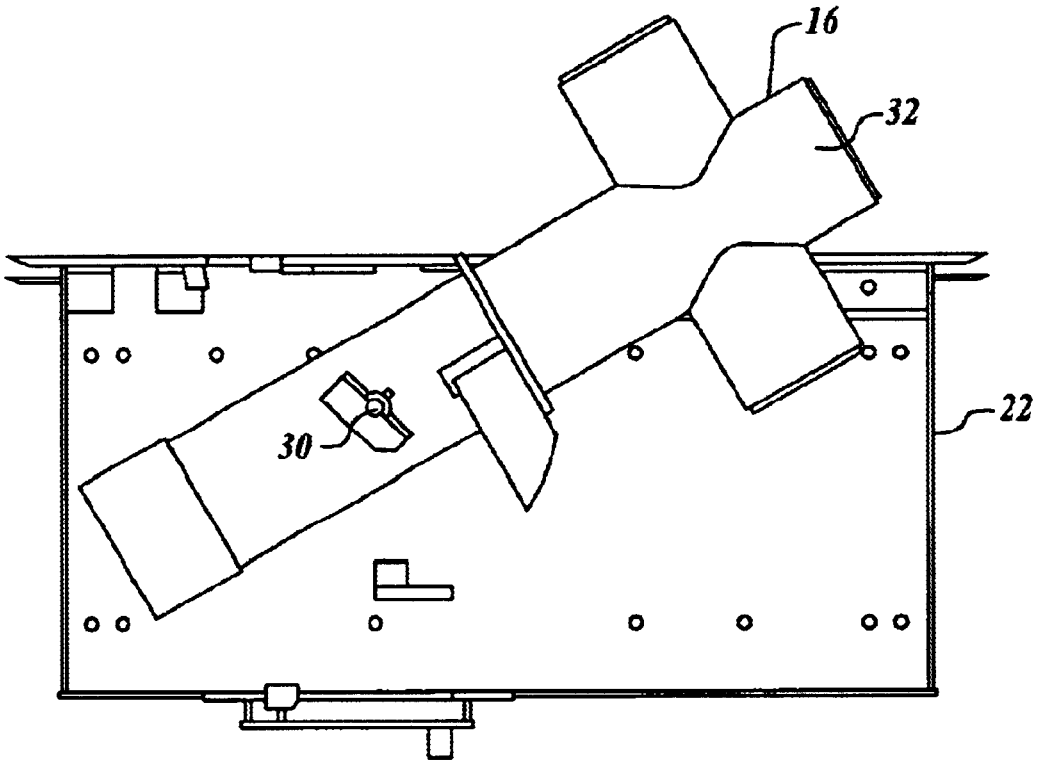

The invention operates as follows. FIG. 3 shows the mooring fitting 16 stowed in the enclosure 22 in the second position 20. The cross member 34 rests on a bottom surface 62 of the enclosure 22. Referring now to FIG. 4, as the counterweight 28 is urged downwardly, the mooring fitting 16 rotates about the axle 30. The cross member 34 begins to exit the enclosure 22. Referring now to FIGS. 5 and 6, as the mooring fitting 16 continues to rotate about the axle 30, the post member 32 begins to exit the enclosure 22.

Figure 7:
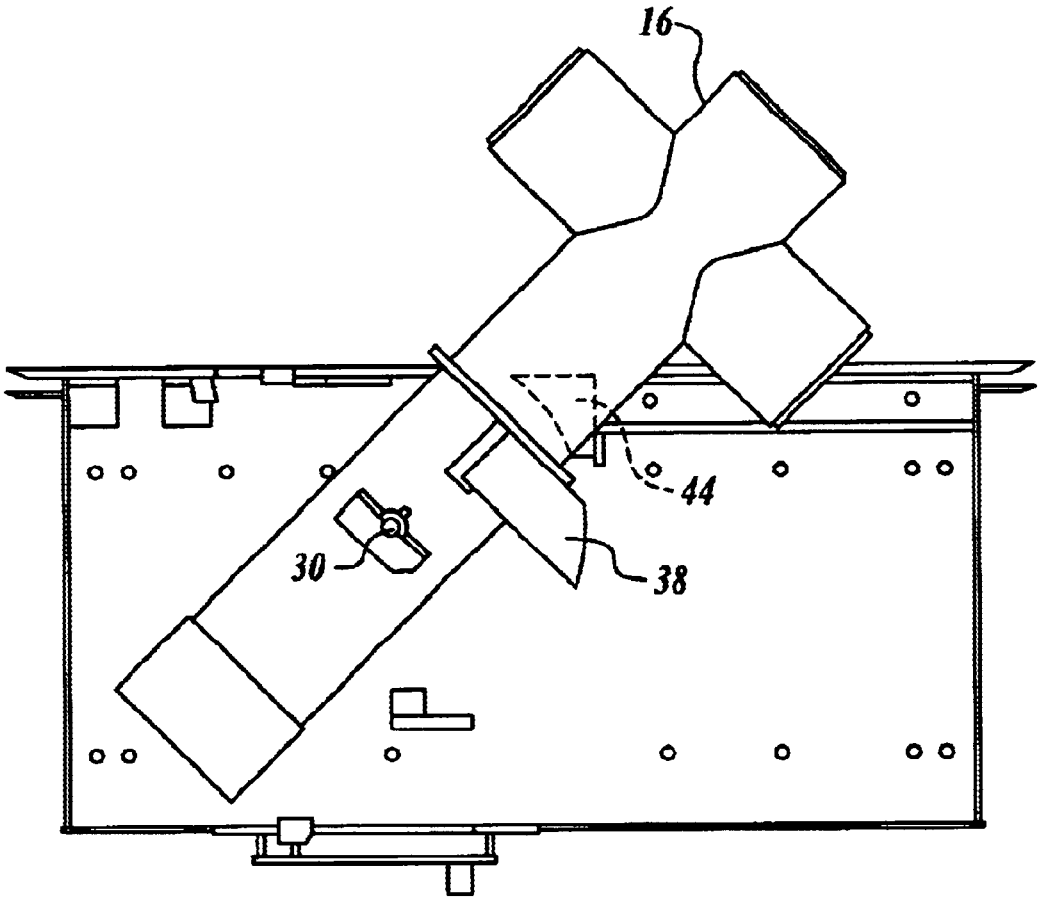
Figure 8:
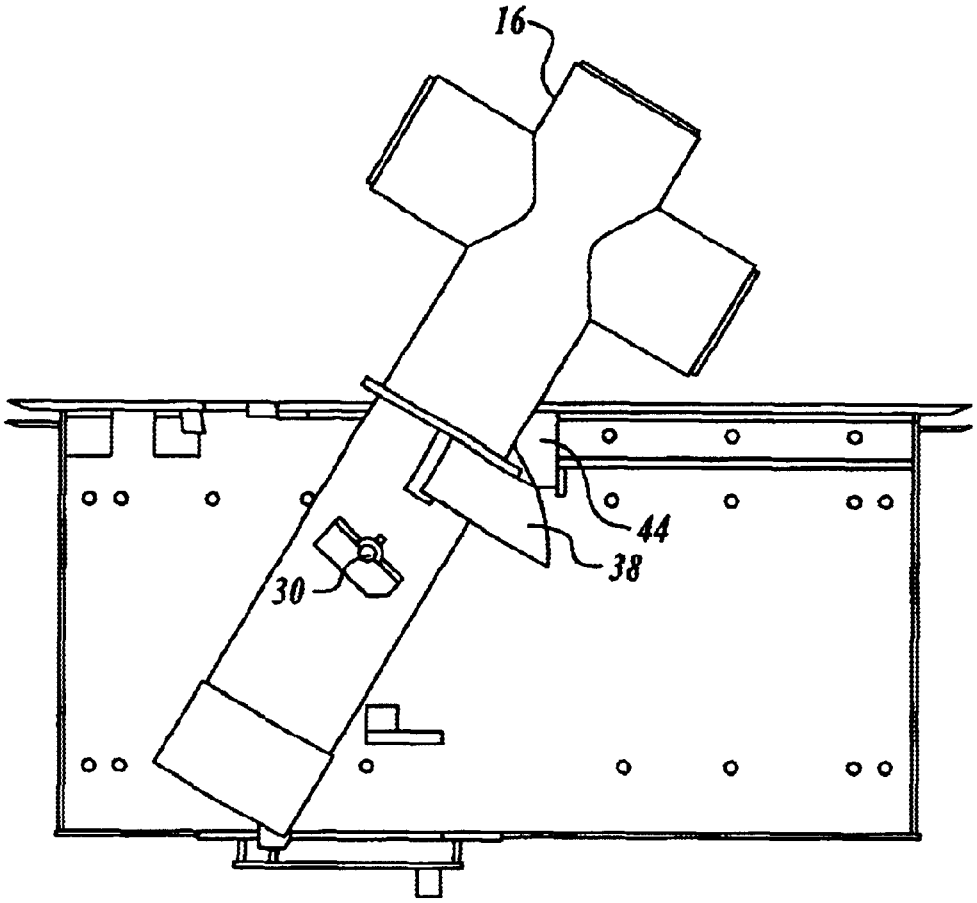
Figure 9:
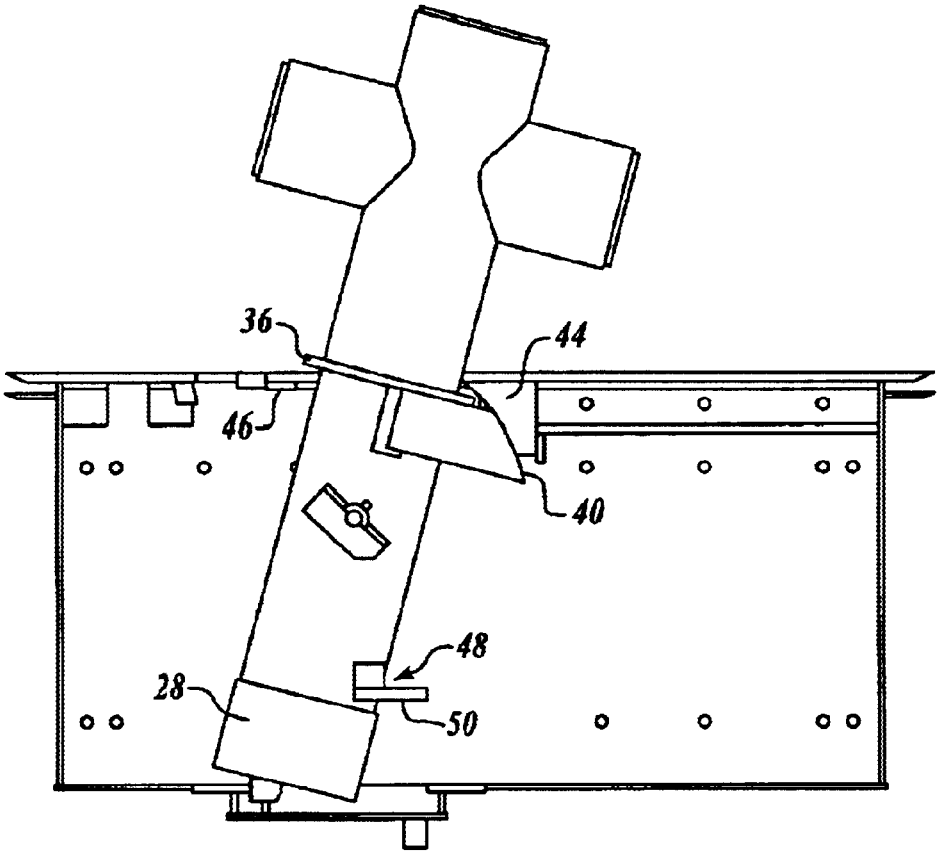

Referring now to FIGS. 7 and 8, the mooring fitting 16 continues to rotate about the axle 30, and the radius bearing 38 approaches the mating radius bearing 44. Referring now to FIG. 9, the radius-bearing surface 40 begins to mate with the surface of the mating radius bearing 44. The section 36 approaches the upper retainer 46, and the counterweight 28 approaches the first surface 50 of the lower retainer 48.

Figure 10:
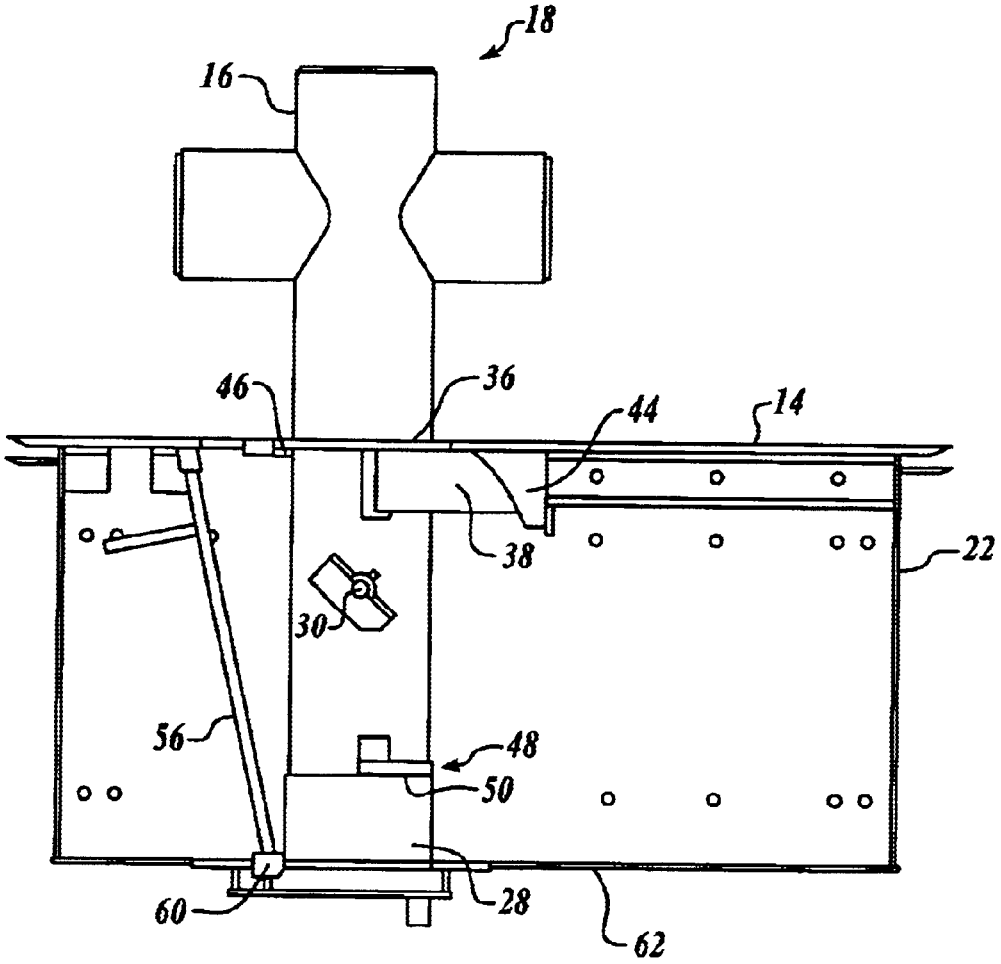

Referring now to FIG. 10 the mooring fitting 16 is fully deployed in the first position 18. The radius bearing 38 mates with the mating radius bearing 44 and the section 36 mates with the deck surface 14 to provide a load path to transfer live load from the mooring fitting 16 to the enclosure 22. The counterweight 28 mates with the bottom surface 62 of the enclosure 22 to provide a load path from the bottom of the mooring fitting 16 to the enclosure 22. Live loads are, in turn, transferred from the deck surface 14 and the mating radius bearing 44 and the bottom surface 62 of the enclosure 22 to the marine vessel (not shown). The counterweight 28 contacts the first surface 50 of the lower retainer 48, thus preventing upward motion. The second end 60 of the elongate member 56 contacts the counterweight 28, thus preventing rotation of the mooring fitting 16 about the axle 30 while the mooring fitting 16 is deployed in the first position 18.

While the preferred embodiment of the invention has been illustrated and described, as noted above, many changes can be made without departing from the spirit and scope of the invention. Accordingly, the scope of the invention is not limited by the disclosure of the preferred embodiment.

What is claimed is:

1. A retractable mooring fitting assembly for a marine vessel, the assembly comprising:

a mooring fitting having a first end and a second end;

a counterweight disposed toward the second end of the mooring fitting; and an axle interposed between the counterweight and the first end, the mooring fitting being pivotable about the axle.

2. The assembly of claim 1, further comprising at least a first bearing attached to the mooring fitting, the at least first bearing being arranged to provide at least a first load path from the mooring fitting to the marine vessel.

3. The assembly of claim 2, wherein the at least first bearing is disposed intermediate the first end of the mooring fitting and the axle.

4. The assembly of claim 2, further comprising a second bearing attached to the mooring fitting, the second bearing being arranged to provide a second load path from the mooring fitting to the marine vessel.

5. The assembly of claim 4, wherein the second bearing is disposed toward the second end of the mooring fitting.

6. The assembly of claim 5, wherein the second bearing includes the counterweight.

7. The assembly of claim 1, wherein the mooring fitting includes a post bitt.

8. A retractable mooring fitting assembly for a marine vessel, the assembly comprising:

a mooring fitting having a first end and a second end;

a counterweight disposed toward the second end of the mooring fitting;

an axle interposed between the counterweight and the first end, the mooring fitting being pivotable about the axle between a first position and a second position;

at least a first bearing attached to the mooring fitting intermediate the first end of the mooring fitting and the axle, the at least first bearing being arranged to provide at least a first load path from the mooring fitting to a marine vessel when the mooring fitting is in the first position; and at least a first retainer that is attachable to the marine vessel, the at least first retainer being arranged to abuttingly receive the at least first bearing when the mooring fitting is in the first position.

9. The assembly of claim 8, further comprising a second bearing attached to the mooring fitting toward the second end of the mooring fitting, the second bearing being arranged to provide a second load path form the mooring fitting to the marine vessel when the mooring fitting is in the first position.

10. The assembly of claim 9, wherein the second bearing includes the counterweight.

11. The assembly of claim 8, further comprising a latching mechanism arranged to releasably secure the mooring fitting in the first position.

12. The assembly of claim 11, wherein the latching mechanism includes an elongated member.

13. The assembly of claim 12, wherein the elongated member has a first end that is releasably attachable to the marine vessel, the elongate member having a second end that is attachable to the mooring fitting.

14. The assembly of claim 13, wherein the first end of the elongate member is pivotably attached to the marine vessel.

15. The assembly of claim 14, wherein the second end of the elongate member is releaseably attachable to the mooring fitting.

16. The assembly of claim 15, wherein the second end of the elongate member is abuttingly attachable to the mooring fitting.

17. The assembly of claim 8, wherein the mooring fitting includes a post bitt.

18. A retractable mooring fitting assembly for a marine vessel, the assembly comprising:

a mooring fitting having a first end and a second end;

a counterweight disposed toward the second end of the mooring fitting;

an axle interposed between the counterweight and the first end, the mooring fitting being pivotable about the axle between a first position and a second position;

at least a first bearing attached to the mooring fitting intermediate the first end of the mooring fitting and the axle, the at least first bearing being arranged to provide at least a first load path from the mooring fitting to a marine vessel when the mooring fitting is in the first position;

an enclosure arranged to receive the mooring fitting therein, the enclosure rotatingly receiving the axle therein, the enclosure being attachable to the marine vessel beneath a deck surface of the marine vessel; and at least a first retainer that is attached to the enclosure, the at least first retainer being arranged to abuttingly receive the at least first bearing when the mooring fitting is in the first position.

19. The assembly of claim 18, wherein further comprising a second bearing attached to the mooring fitting toward the second end of the mooring fitting, the second bearing being arranged to provide a second load path from the mooring fitting to the marine vessel when the mooring fitting is in the first position.

20. The assembly of claim 18, wherein the enclosure further includes a latching mechanism arranged to releasably secure the mooring fitting in the first position.

21. The assembly of claim 20, wherein the latching mechanism includes an elongate member having a first end that is attachable to the enclosure and a second end that is attachable to the mooring fitting.

22. The assembly of claim 18, wherein the mooring fitting includes a post bitt.

23. A marine vessel comprising:

a hull having a plurality of sides;

a deck attached to tops of the plurality of sides; and a retractable mooring fitting assembly including:

a mooring fitting having a first end and a second end;

a counterweight disposed toward the second end of the mooring fitting; and an axle interposed between the counterweight and the first end, the mooring fitting being pivotable about the axle between a first position and a second position.

24. The marine vessel of claim 23, further comprising an enclosure arranged to receive the mooring fitting therein, the enclosure rotatingly receiving the axle therein, the enclosure being attachable to the marine vessel beneath the deck.

25. The marine vessel of claim 24, further comprising at least a first bearing attached to the mooring fitting intermediate the first end of the mooring fitting and the axle, the at least first bearing being arranged to provide at least a first load path from the mooring fitting to the marine vessel when the mooring fitting is in the first position.

26. The marine vessel of claim 25, further comprising at least a first retainer that is attached to the enclosure, the at least first retainer being arranged to abuttingly receive the at least first bearing when the mooring fitting is in the first position.

27. The marine vessel of claim 26, further comprising a second bearing attached to the mooring fitting toward the second end of the mooring fitting, the second bearing being arranged to provide a second load path from the mooring fitting to the marine vessel when the mooring fitting is in the first position.

28. The marine vessel of claim 23, wherein the enclosure further includes a latching mechanism arranged to releaseably secure the mooring fitting in the first position.

29. The marine vessel of claim 28, wherein the latching mechanism includes an elongate member having a first end that is attachable to the enclosure and a second end that is attachable to the mooring fitting.

30. The marine vessel of claim 23, wherein the mooring fitting includes a post bitt.

31. The marine vessel of claim 23, wherein the marine vessel includes a barge.

32. The marine vessel of claim 23, wherein the marine vessel includes a tugboat.

* * * * *